US009364073B1

(12) United States Patent
Horner

(10) Patent No.: US 9,364,073 B1
(45) Date of Patent: Jun. 14, 2016

(54) SURVIVAL PAD WITH STORAGE CAPABILITIES

(71) Applicant: Brian K. Horner, Anchorage, AK (US)

(72) Inventor: Brian K. Horner, Anchorage, AK (US)

( * ) Notice: Subject to any disclaimer, the term of this patent is extended or adjusted under 35 U.S.C. 154(b) by 348 days.

(21) Appl. No.: 14/051,831

(22) Filed: Oct. 11, 2013

(51) Int. Cl.
*A45C 15/00* (2006.01)
*A45F 4/02* (2006.01)
*A45C 11/24* (2006.01)

(52) U.S. Cl.
CPC .. *A45F 4/02* (2013.01); *A45C 11/24* (2013.01)

(58) Field of Classification Search
CPC ..... A45C 11/24; A45C 11/182; A45C 15/00; A45F 4/02
USPC ..... 206/37, 38, 223, 234, 85, 86, 531, 532, 206/534, 462, 806, 803
See application file for complete search history.

(56) References Cited

U.S. PATENT DOCUMENTS 4,300,610 A * 11/1981 China ..... A45C 11/326 206/37
4,974,771 A * 12/1990 Lavery ..... B65D 5/725 206/141
5,014,851 A * 5/1991 Wick ..... A61J 1/035 206/461
5,954,202 A * 9/1999 Mellon ..... B65D 75/14 206/462
5,975,302 A * 11/1999 Young ..... G09F 3/20 206/39
6,619,480 B2 * 9/2003 Smith ..... B65D 73/0078 206/454
2009/0057184 A1 * 3/2009 Leaman ..... B65D 75/366 206/532
2010/0252478 A1 * 10/2010 Beecroft ..... B65D 83/0463 206/531
2010/0264055 A1 * 10/2010 Eisenberg ..... A61J 1/03 206/532

* cited by examiner

*Primary Examiner* — Luan K Bui
(74) *Attorney, Agent, or Firm* — Michael J. Tavella

(57) ABSTRACT

A survival pad that contains a variety of survival tools, but can, in itself, be used for a variety of survival implements. Survival items are imbedded in an insulating pad that is designed to slide into a daypack, backpack or vehicle survival kit. The invention is designed for everyday field use as well as unplanned emergencies. The pad can store items such as a rescue marker, light, whistle, pill pack, tape, flint, can opener, fire brick, compass, survey tape, candies, poncho lighter, sunscreen and/or a mirror. The pad can be used as a waterproof field "note pad". It can also be used to build fires, fan fires, and collect food. The pad can be easily converted to a sun/rain hat or used as a body insulator, seat, or fishing float, or emergency signal, or as an emergency splint, or hiker knee brace or large game foot snare.

18 Claims, 9 Drawing Sheets

SURVIVAL PAD WITH STORAGE CAPABILITIES

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to survival pads and particularly to survival pads with integral storage capabilities.

2. Description of the Prior Art

There are many devices that are survival kits. These kits are often part of a flashlight or other tool in which a hollow handle is used to store various types of survival gear such a waterproof matches, fish hooks and line, a whistle and a compass. Of course many other items can be included as well.

While versatile, these kits all lack true versatility in that they have one primary function (e.g., flashlight) that has a storage compartment for small survival items. In a true survival situation, these devices require the user to find other items to make snares, splints, hats, etc., that will ensure survival.

BRIEF DESCRIPTION OF THE INVENTION

The instant invention overcomes these difficulties. It is a survival pad that contains a variety of survival tools, but can, in itself, be used for a variety of survival implements. The invention combines a way to carry essential survival equipment and also have a multi-functional protective device for a variety of environments and activities. Survival items are imbedded in an insulating pad that is designed to slide into a daypack, backpack or vehicle survival kit. The invention is designed for both everyday field use and for those unplanned emergencies where a small amount of equipment can make a big difference.

Each pad comes with a training DVD that guides the user through the equipment that is included in each pad and the usage of the pad itself.

There are several different embodiments of the device depending on the level of activity. For example, the basic model includes a pad with a plastic knife. Other models can include items such as a rescue marker, light, whistle, pill pack, tape, flint, can opener, fire brick, compass, survey tape, candies, poncho lighter, sunscreen and a mirror. Besides the survival items that are stored in the pad, as, noted, the pad is also useful as a survival tool, or just a convenient accessory. The pad can be used as a waterproof field "note pad". It can also be used to build fires, fan fires, and collect food. The pad can be easily converted to a sun/rain hat or used as a body insulator, seat, or fishing float, or emergency signal, or as an emergency splint, or hiker knee brace or large game foot snare. Thus, this invention is an all-around useful survival tool for any type of outdoor activity.

DETAILED DESCRIPTION OF THE INVENTION

Figure 1:
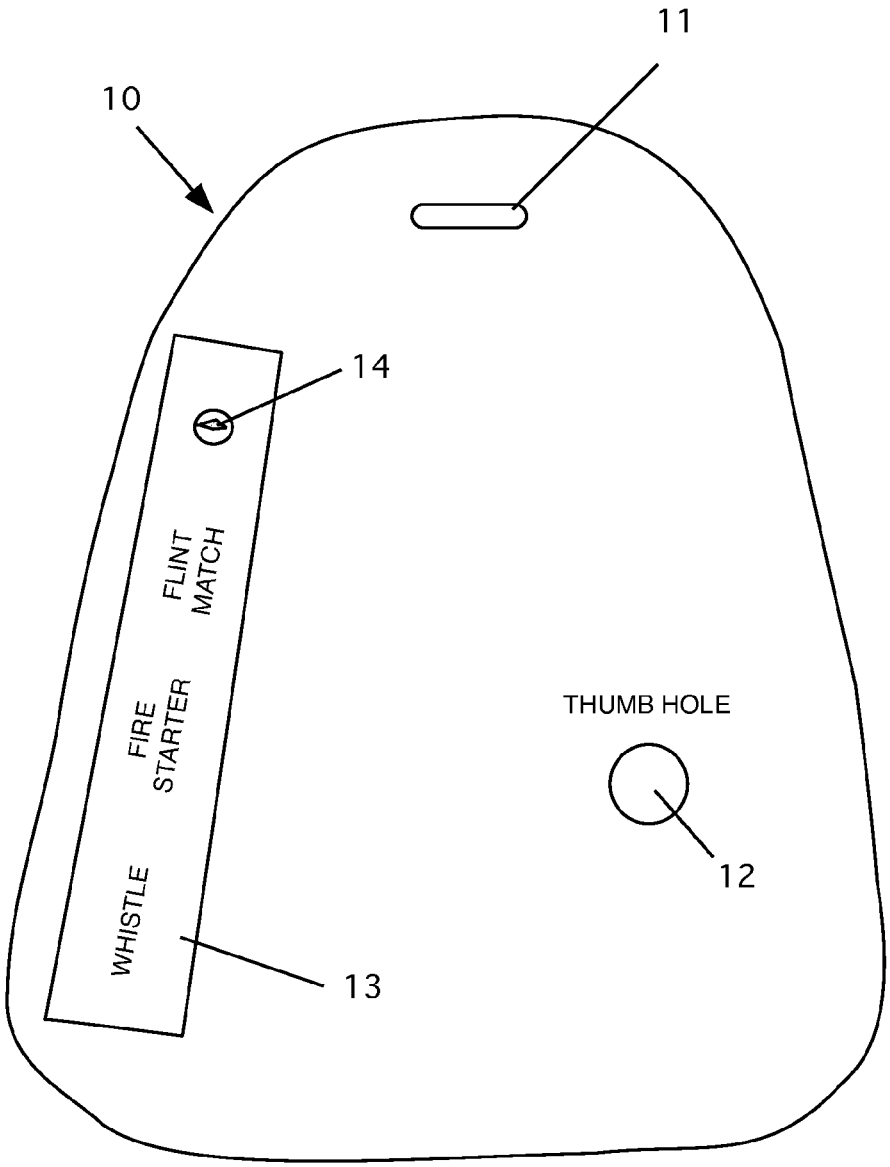
FIG. 1 is a top plan view of one embodiment of the invention.

Referring now to FIG. 1, the invention 10 the pad has an oblong shape and is flat. In the preferred embodiment, the pad has a thickness of one-half inch (see, FIG. 2). However, this can vary from ⅜-inches to ¾ inches. The pad 10 has a hole 11 at the top to secure a sling or rope. The pad also has a thumb hole 12 that is used for when the pad is used as a sling (see, e.g., FIG. 5). It can also be used to grip the pad when used as a signal or as a fire fan. At the side of the pad is a line of tape 13 that has labels for a whistle, fire starter, and a flint match that are stored within the pad under the tape (see, e.g., FIGS. 2, 3 and 4). In one embodiment, a compass 14 can be embedded in the tape as shown. Here, the face of the compass is exposed so that it can be used to guide a person without having to remove it from the pad. As noted below, many other items can be stored in the compartment. These items are listed below. The pad can be customized for different users and the selection of items picked for specific uses. For example, a basic model can include a pad with a plastic knife.

A model used for rescue can include a marker, light, whistle, pill pack, tape, and antiseptic pads. A pad used for basic survival can include flint, a can opener, a fire brick, a compass, and a knife. A pad for a child could include survey tape, candies, a whistle, or a poncho. A pad for a hiker might include a lighter, sunscreen, a spoon/fork, a mirror, and a compass. A pad can be designed for use with pets that can include a leash, pad balm, and a waste bag. As is clear, the pad can be customized in any number of ways.

Figure 2:
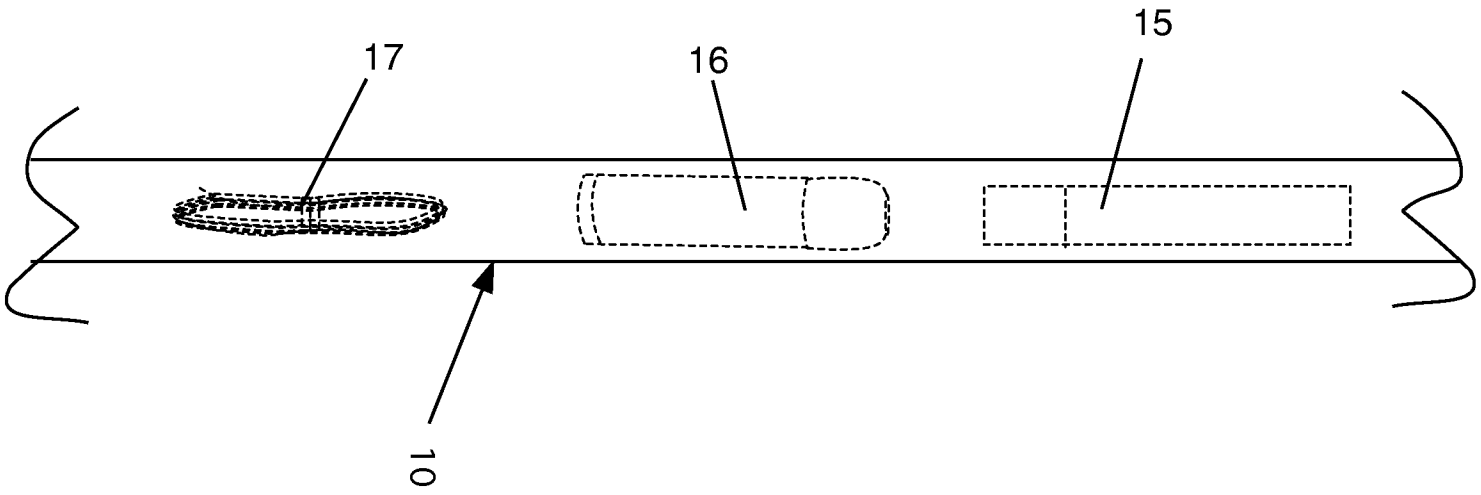
FIG. 2 is a side view of a portion of the invention showing items stored within it.

FIG. 2 is a side view of a portion of the invention 10 showing items stored within it as well as the thickness of the pad. In this view, a lighter 15, lip balm 16 and twine 17 are in the storage compartment 18 in the pad.

Figure 3:
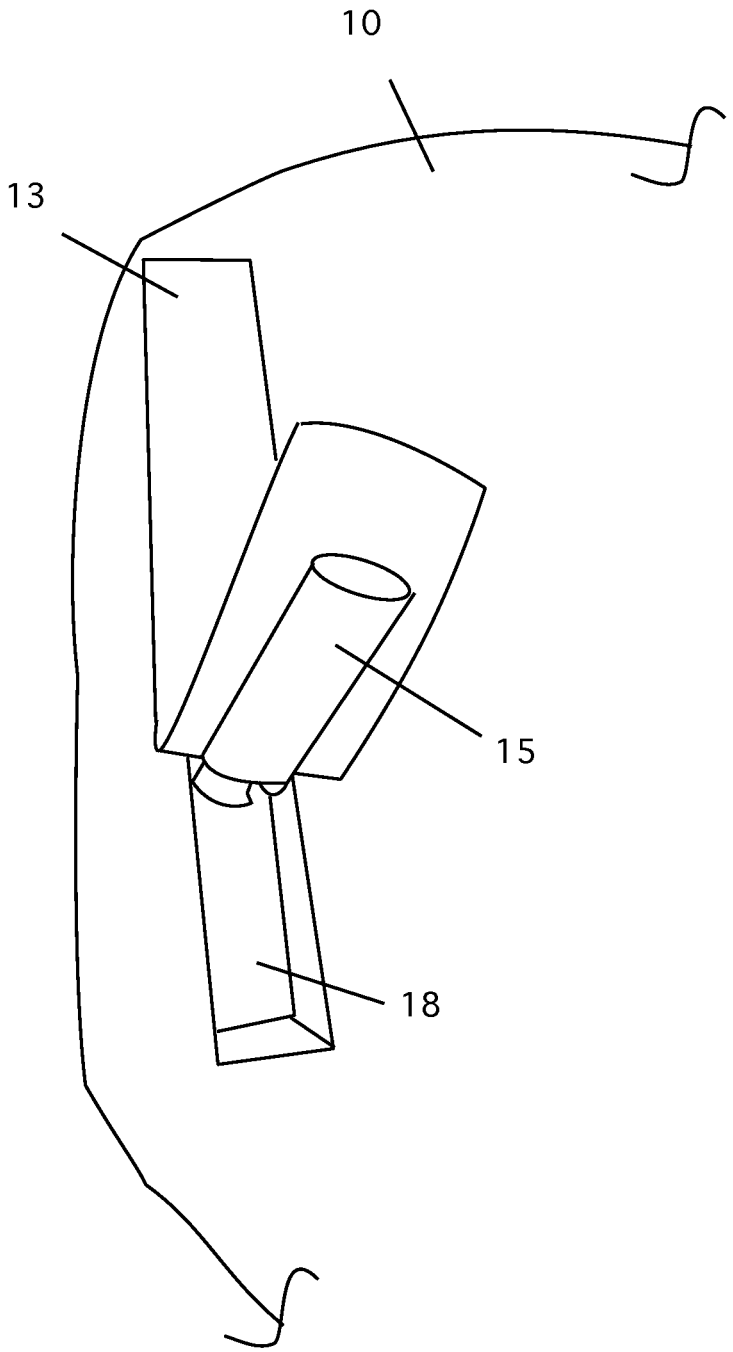
FIG. 3 is a detail showing a lighter stored in the pad being lifted from the storage compartment.

FIG. 3 is a detail showing a lighter stored in the pad being lifted from the storage compartment. Here the compartment 18 that is used to store the supplies is shown. The tape 13 is show partially retracted and a lighter 15 is shown attached to the tape. Although it is possible to form a cavity within the pad, in the preferred embodiment, the cavity is cut through the mat and the bottom of the cavity is sealed with more tape. See FIG. 3*a*.

Figure 3A:
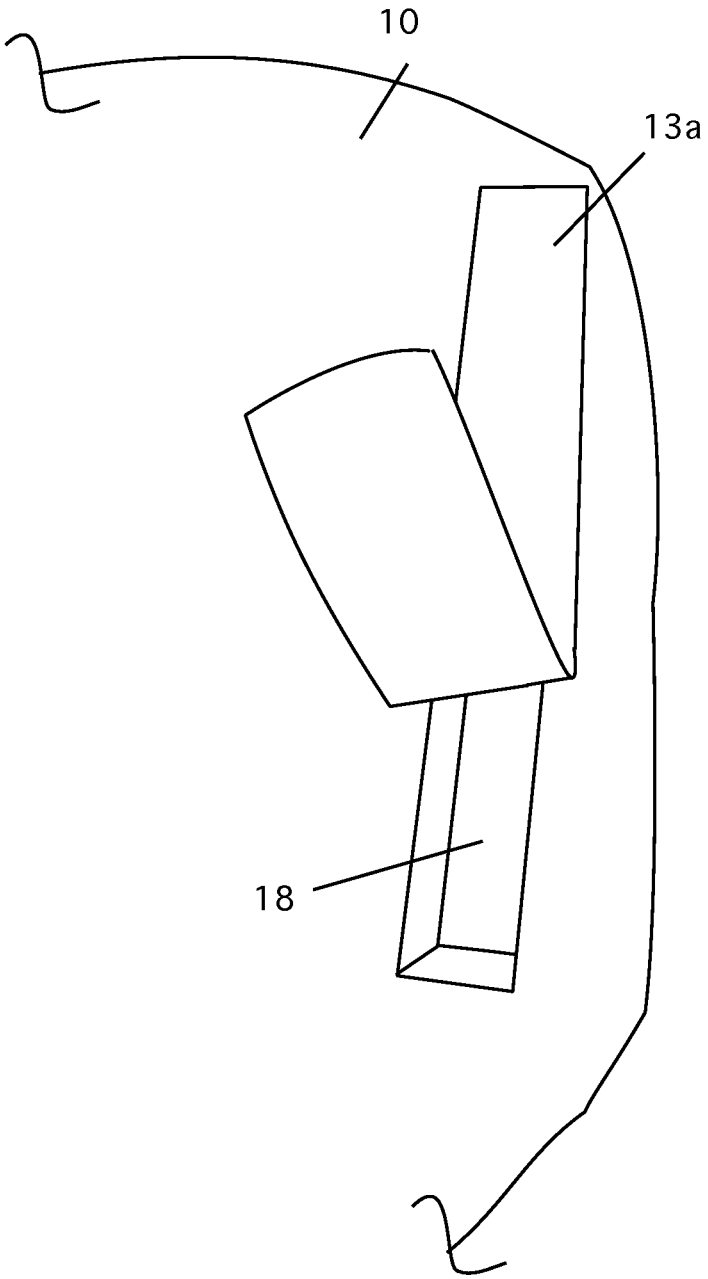
FIG. 3*a* is a bottom view of the pad showing the open cavity and the bottom tape that is used to seal the cavity for use.

FIG. 3*a* is a bottom view of the pad showing the open cavity and the bottom tape that is used to seal the cavity for use. In this view, the pad 10 is shown on the reverse side. The cavity 18 is shown going all the way through the pad. The tape 13*a* is shown partially retracted, but, in normal operation, it would remain in place. Of course, in certain cases, it could be removed to allow the cavity 18 to be fully opened.

Figure 4:
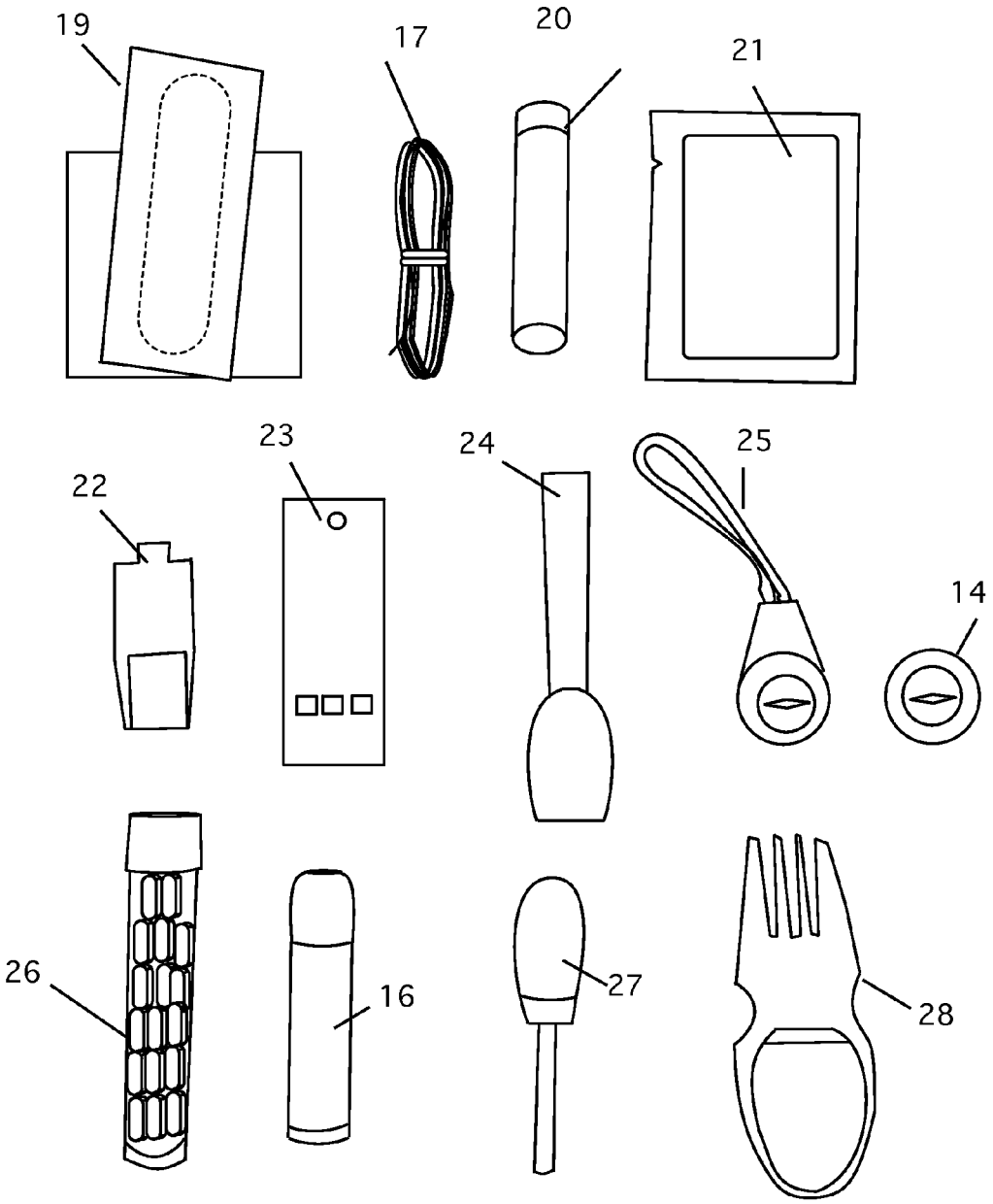
FIG. 4 is a detail showing a variety of items that can be stored in the pad.

As noted above, many items can be stored in the cavity 18 and the items can be selected to create different types of pad kits for sale. FIG. 4 is a detail showing a variety of items that can be stored in the pad. These items include: adhesive bandages 19, twine 17, sunscreen 20, mosquito repellant 21, Whistles 22 and 23, a spoon 24 compasses 25 and 14, a pill tube 26, lip balm 16, a flint 27 and a combination spoon/fork 28. Obviously, many other items such as waterproof matches, water purification tablets, signal mirrors, medicines, candles and many other items can be packed into the pad. Also, in parties, different pads can be carried among the participants, ensuring a complete range of emergency supplies can be available as needed.

The real versatility of the pad, however, is not its ability to carry supplies-many such carriers exist—but that it can be used as a survival tool in a variety of ways.

Figure 5:
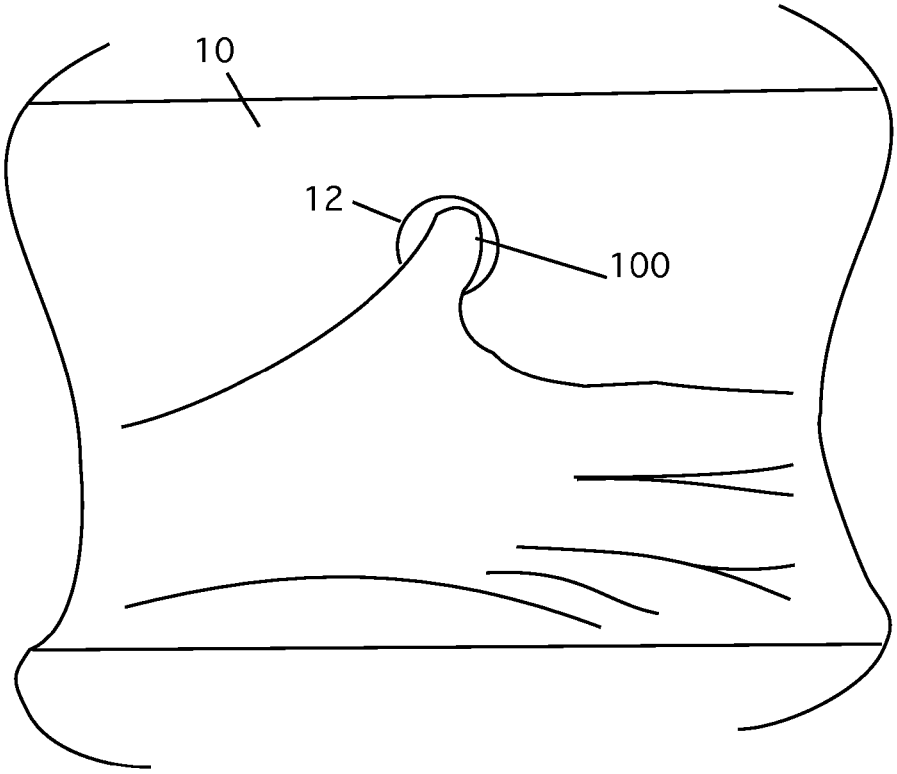
FIG. 5 is a detail view of a first step of the pad being used as a splint.
Figure 6:
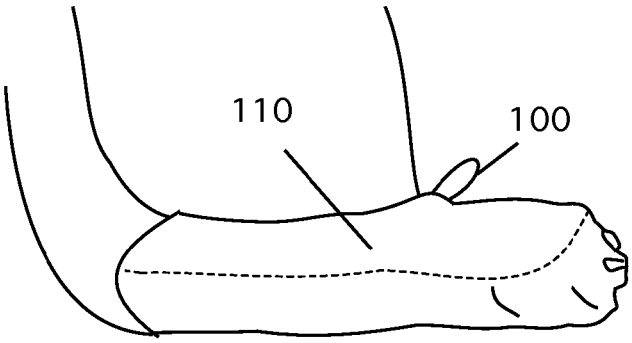
FIG. 6 shows the pad fully wrapped about an arm as a splint.
Figure 7:
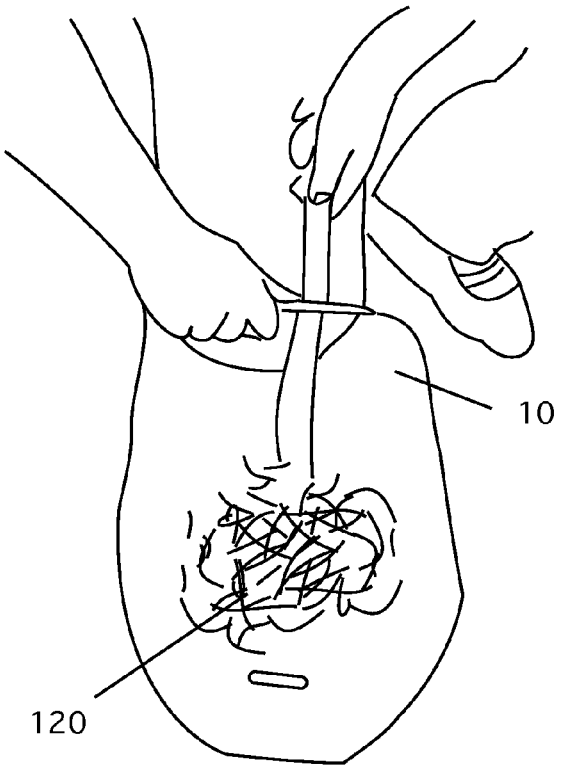
FIG. 7 is a detail view of the pad being used as a fire starter.

For example, the pad can be used as an emergency splint. FIG. 5 is a detail view of a first step of the pad being used as a splint. Here, the injured party placed his thumb 100 through the thumb hole 12 on the pad 10. Next, as shown in FIG. 7, the pad is wrapped about the injured arm and secured with tape or bandages 110 as available. The pad acts as a soft, form fitting emergency splint that protects the injury while also keeping the extremity warm. In the preferred embodiment, the thumb hole 12 is not initially removed, but perforated. Directions are given for removing the "pre-punched" thumb hole when needed.

As noted, the pad acts as an insulator. Thus, it can be used for protected sitting & kneeling on wet or cold ground.

The pad is a waterproof field "note pad" for recording patient medical data, weather observations or diary entrees. It can also be used to record notes on any other field observations.

FIG. 7 is a detail view of the pad being used as a fire starter. Here, the pad 10 provides a waterproof barrier for your dry wood shavings 120, and a small piece of the pad even acts as an emergency fire starter. The pad can also be used to fan the fire ensuring that the fire will truly catch and burn.

Figure 8:
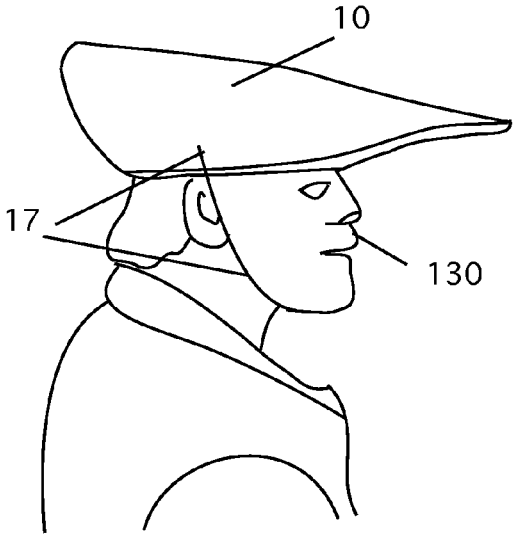
FIG. 8 is a detail view of the pad being used as a hat.

FIG. 8 is a detail view of the pad being used as a hat. As shown, the pad 10 can be used as both sun and rain head protection. It also provides insulating warmth. The pad 10 is simply secured over the head 130 with some twine 17.

Besides keeping the user's head warm, one or more pads can provide a fast way to add thermal protection while waiting for help or hiking back down the trail. One pad placed on the chest stops heat loss. Three pads with your daypack will surround a torso with waterproof insulation.

Figure 9:
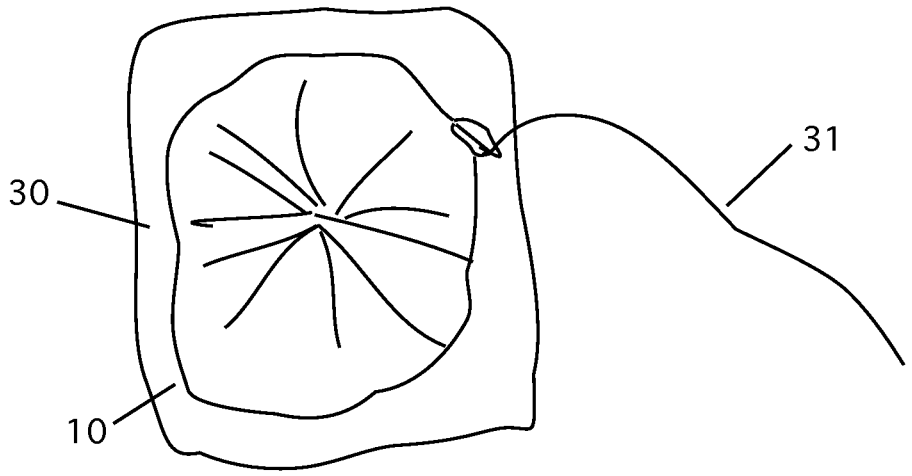
FIG. 9 is a detail view of the pad being used as a snare.

FIG. 9 is a detail view of the pad being used as a snare. As shown, the pad 10 can be used as part of a foot trap to capture large game animals. A 10"×10" piece of the pad is cut with a star pattern 30. After it's placed over a hole, the pad 10 is laid down to create a carrier for the noose 31.

Figure 10:
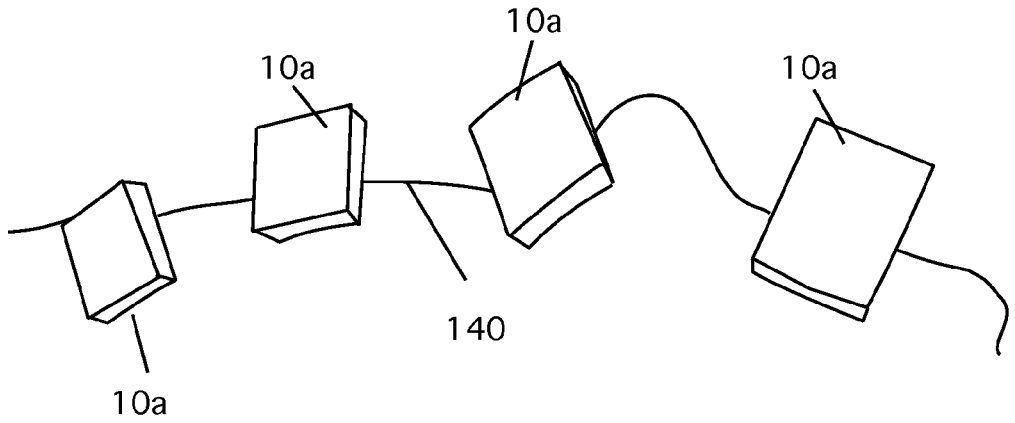
FIG. 10 is a detail view of pieces of the pad being used as floats for a fishing net.
Figure 11:
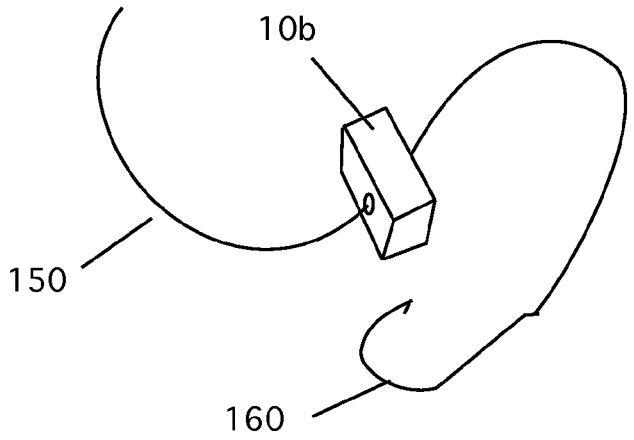
FIG. 11 shows a detail view of a piece of the pad being used as a float for a fishing line.

FIG. 10 is a detail view of pieces of the pad being used as floats for a fishing net. Here, small pieces of the pad 10*a* act as flotation for the top line of your survival gill net 140. FIG. 11 shows a detail view of a piece of the pad being used as a float for a fishing line. As above, a small piece of the pad 10*b* can be used as a float for use with a fishing line 150 and hook 160.

The pad can be used as an emergency signal by helping to makes bigger, brighter movement that makes a user visible from the background. In one embodiment, the pad rescue comes in bright orange, which can increase visibility.

Each pad 10 has over 3.5 lbs of inherent buoyancy, which can assist in personal flotation. Moreover, one or more pads can be wrapped around equipment that needs flotation.

The pad can be used for many other purposes as well. For example, the pad can be wrapped around the back of the knee to give some support as well as enhance the application of ice to knee injuries. The pad allows survival equipment to be mounted directly into the pad itself. The pad can include preprinted safety information on its surface.

Finally, in another embodiment, the tape 13 can be replaced with a hook and loop type fastener for the equipment closure, which allows items to be removed from the pad and replaced for storage as needed.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A survival pad with integral storage capabilities comprising:

a) a flat pad having an oblong shape and a thickness, said pad further having a top hole formed therein, said pad further having a thumb hole formed therein, said pad further having a compartment formed therein to receive articles;

b) a means for sealing said compartment removably installed on said pad such that the compartment is completely sealed said means comprising a strip of tape covering said compartment;

c) at least one item, stored in said compartment; and a compass is embedded in said strip of tape such that face of the compass is exposed.

2. The survival pad of claim 1 wherein the thumb hole is sealed with a perforated member.

3. The survival pad of claim 1 wherein the strip of tape is printed with a list of items stored within said compartment.

4. The survival pad of claim 1 wherein the thickness of said pad is about one-half inch.

5. The survival pad of claim 1 wherein the top hole is sized to secure a sling or rope.

6. The survival pad of claim 1 wherein the at least one item is selected from the group of adhesive bandages, twine, sunscreen, mosquito repellant, a whistle, a spoon, a compass, a pill tube, lip balm, a flint, and a combination spoon/fork.

7. The survival pad of claim 1 wherein the pad has a surface capable of accepting ink for writing thereon.

8. The survival pad of claim 7 wherein the surface capable of accepting ink is colored for use as an emergency signal.

9. The survival pad of claim 1 wherein the pad is flexible.

10. The survival pad of claim 1 wherein said pad is sized to fit over an adult human arm, for use as an emergency splint.

11. The survival pad of claim 1 wherein said pad is sized to fit over an entrapment hole for use as a foot trap.

12. The survival pad of claim 6 wherein said compartment is oblong.

13. The survival pad of claim 12 wherein a plurality of items can be stored in said compartment.

14. The survival pad of claim 1 wherein said pad is formed of a material such that said pad is cut into a plurality of smaller pieces.

15. The survival pad of claim 14 wherein one of said plurality of smaller pieces comprises a fish float.

16. The survival pad of claim 14 wherein said plurality of smaller pieces comprises a plurality of fish floats for a fishing net.

17. The survival pad of claim 1 wherein said pad is sized to form a hat.

18. The survival pad of claim 1 wherein said pad has a material that acts as an insulator.

* * * * *